United States Patent [19]

Owen

[11] Patent Number: 4,980,051

[45] Date of Patent: Dec. 25, 1990

[54] PROCESS AND APPARATUS FOR PREHEATING HEAVY FEED TO A CATALYTIC CRACKING UNIT

[75] Inventor: Hartley Owen, Belle Mead, N.J.

[73] Assignee: Mobil Oil Corporation, Fairfax, Va.

[21] Appl. No.: 439,754

[22] Filed: Nov. 21, 1989

[51] Int. Cl.[5] ..... C10G 55/06

[52] U.S. Cl. ..... 208/113; 208/163; 208/120; 208/81; 208/100

[58] Field of Search ..... 208/113, 127, 108

[56] References Cited

U.S. PATENT DOCUMENTS

| | | | |
|---|---|---|---|
| 3,338,821 | 8/1967 | Moyer et al. | 208/113 |
| 4,325,817 | 4/1982 | Bartholic et al. | 208/113 |
| 4,497,638 | 2/1985 | Johnson et al. | 208/127 |
| 4,775,461 | 10/1988 | Harris et al. | 208/113 |
| 4,822,761 | 4/1989 | Walters et al. | 502/38 |

OTHER PUBLICATIONS

"Petroleum Refinery Manual", Henry Martyn Noel, 1959.

"Troubleshooting Process Operations", Norman P. Lieberman, 1985.

*Primary Examiner*—Helane E. Myers

*Attorney, Agent, or Firm*—Alexander J. McKillop; Charles J. Speciale; Richard D. Stone

[57] ABSTRACT

A process and apparatus for preheating and catalytic cracking of heavy oils is disclosed. Direct contact heat exchange of heavy feed, such as a resid, with hot product vapor from the cracking reactor provides an efficient way to preheat a heavy feed to an unusually high temperature, preferably in excess of 600° F. Cooling hot cracked products from an FCC or TCC reactor upstream of the main fractionator reduces thermal cracking in the transfer line. High temperature preheat reduces the viscosity of the heavy feed, improves contact of heavy feed with cracking catalyst and reduces the amount of catalyst required to effect the catalytic cracking reaction. This improves yields, permits higher cracking reactor temperatures, and reduces cat:oil coke make.

18 Claims, 3 Drawing Sheets

PROCESS AND APPARATUS FOR PREHEATING HEAVY FEED TO A CATALYTIC CRACKING UNIT

BACKGROUND OF THE INVENTION

1. FIELD OF THE INVENTION

The field of the invention is catalytic cracking of heavy hydrocarbon feeds using a moving or fluidized bed of cracking catalyst.

2. DESCRIPTION OF RELATED ART

Catalytic cracking is the backbone of many refineries. It converts heavy feeds into lighter products by catalytically cracking large molecules into smaller molecules. Catalytic cracking operates at low pressures, without hydrogen addition, in contrast to hydrocracking, which operates at high hydrogen partial pressures. Catalytic cracking is inherently safe as it operates with very little oil actually in inventory during the cracking process.

There are two main variants of the catalytic cracking process: moving bed and the far more popular and efficient fluidized bed process.

In the fluidized catalytic cracking (FCC) process, catalyst, having a particle size and color resembling table salt and pepper, circulates between a cracking reactor and a catalyst regenerator. In the reactor, hydrocarbon feed contacts a source of hot, regenerated catalyst. The hot catalyst vaporizes and cracks the feed at 425° C.–600° C., usually 460° C.–560° C. The cracking reaction deposits carbonaceous hydrocarbons or coke on the catalyst, thereby deactivating the catalyst. The cracked products are separated from the coked catalyst. The coked catalyst is stripped of volatiles, usually with steam, in a catalyst stripper and the stripped catalyst is then regenerated. The catalyst regenerator burns coke from the catalyst with oxygen containing gas, usually air. Decoking restores catalyst activity and simultaneously heats the catalyst to, e.g., 500° C.–900° C., usually 600° C.–750° C. This heated catalyst is recycled to the cracking reactor to crack more fresh feed. Flue gas formed by burning coke in the regenerator may be treated for removal of particulates and for conversion of carbon monoxide, after which the flue gas is normally discharged into the atmosphere.

Catalytic cracking is endothermic, it consumes heat. The heat for cracking is supplied at first by the hot regenerated catalyst from the regenerator. Ultimately, it is the feed which supplies the heat needed to crack the feed. Some of the feed deposits as coke on the catalyst, and the burning of this coke generates heat in the regenerator, which is recycled to the reactor in the form of hot catalyst.

Catalytic cracking has undergone much development since the 40s. The trend has been from moving bed cracking to fluid bed cracking. The trend in fluid catalytic cracking (FCC) has been to all riser cracking and use of zeolite catalysts.

Zeolite-containing catalysts having high activity and selectivity are now used in most FCC units. These catalysts work best when coke on the catalyst after regeneration is less than 0.1 wt %, and preferably less than 0.05 wt %.

To regenerate FCC catalysts to these low residual carbon levels, and to burn CO completely to CO2 within the regenerator (to conserve heat and minimize air pollution) many FCC operators add a CO combustion promoter metal to the catalyst or to the regenerator.

U.S. Pat. Nos. 4,072,600 and 4,093,535, which are incorporated by reference, teach use of combustion-promoting metals such as Pt, Pd, Ir, Rh, Os, Ru and Re in cracking catalysts in concentrations of 0.01 to 50 ppm, based on total catalyst inventory.

Modern, zeolite based catalysts are so active that the feed can be cracked to lighter, more valuable products in less time. Instead of dense bed cracking, with a hydrocarbon residence time of 20–60 seconds, less contact time is needed. Conversion of feed can now be more efficiently achieved in a dilute phase, riser reactor.

As the process and catalyst improved, refiners used the process to upgrade heavier feedstocks.

These heavier, dirtier feeds placed a growing demand on the reactor and on the regenerator. Processing resids exacerbated existing problem areas in the riser reactor, namely feed vaporization, catalyst oil contact, accommodation of large molar volumes in the riser, and coking in the transfer line from the reactor to the main fractionator. Each of these problem areas will be briefly discussed.

Feed vaporization is a severe problem with heavy feeds such as resids. The heavy feeds are viscous and difficult to preheat in conventional preheaters. Most of the heating and vaporization of these feeds occurs in the base of the riser reactor, where feed contacts hot, regenerated catalyst. Because of the high boiling point, and high viscosity, of heavy feed, feed vaporization takes longer in the riser, and much of the riser length is wasted in simply vaporizing feed. Multiple feed nozzles, fog forming nozzles, etc., all help some, but most refiners simply add more atomizing steam. Use of large amounts of atomizing steam helps produce smaller sized feed droplets in the riser, and these smaller sized drops are more readily vaporized. With some resids, operation with 3–5 wt % steam, or even more, approaching in some instances 5–10 wt % of the resid feed, is needed to get adequate atomization of resid. All this steam helps vaporize the feed, but wastes energy because the steam is heated and later condensed. It also adds a lot of moles of material to the riser. The volume of steam approaches that of the volume of the vaporized resid in the base of the riser. This means that up to half of the riser volume is devoted to steaming (and deactivating) the catalyst, rather than cracking the feed.

In U.S. Pat. No. 4,427,537, which is incorporated herein by reference, higher temperature cracking of resids was advocated. The resid was added to the base of a riser reactor as a fog of oil droplets in diluent. High temperatures in the base of the riser, at least equal to or above the pseudo critical temperature of the oil feed, caused a thermal shock which promoted thermal cracking of large molecules into smaller molecules which could be recracked catalytically in the gas phase.

In U.S. Pat. No. 4,816,137, which is incorporated herein by reference, high temperature cracking of resids was achieved using a two stage regenerator which produced extremely hot regenerated catalyst. The first regeneration stage operated at 1150°–1500° F., in partial CO combustion mode, to produce a flue gas comprising large amounts of CO. This first stage of regeneration removed most of the hydrogen from the coke on catalyst. Regeneration was then completed in a second stage of regeneration at 1400°–1800° F. The second stage of regeneration was isolated from the first stage, and the second stage operated relatively dry, so the catalyst was not steamed as much in the second stage.

This approach required construction of a special, multi-stage regenerator, with external, refractory lined cyclones on the second stage, but it was a way to get the very hot catalyst required to vaporize feeds containing 10 or 20 wt % or more of resid. The hydrocarbon feed was preheated to a temperature below 800° F., then mixed with enough very hot catalyst to achieve a mix temperature above the feed pseudo-critical temperature.

In U.S. Pat. No. 4,818,372, which is incorporated herein by reference, high temperature thermal cracking of resid in the base of a riser was followed by quenching and catalytic cracking in the riser. Enough extremely hot catalyst was added to a resid feed, which was preheated to 150° C., to achieve a mix temperature in the base of a riser of 595° C. The patentee recognized that higher feed preheat temperatures would improve feed vaporization, but the highest feed preheat temperature reported was 150° C.

Although the general approach of U.S. Pat. No. 4,816,137 and U.S. Pat. No. 4,818,372 would help vaporize resids, it might make downstream processing more difficult, particularly if a feed with a high coking tendency was being cracked.

Coking in the transfer lines and fractionation columns associated with the cracking reactors is a problem in many catalytic cracking units. FCC operators have long known that "dead spaces" in a line or a process vessel could lead to coke formation. Coke formation is a frequently encountered problem in the "dome" or large weldcap which forms the top of the vessel housing the riser reactor cyclones. If oil at high temperature is allowed to remain stagnant for a long time, it will slowly form coke. For this reason refiners have routinely added a small amount of "dome steam", typically 500 #/hr, to prevent formation of coke in the dome of an FCC unit. Coking in the transfer line is somewhat related, in that coke will form in stagnant or dead areas of the transfer line.

Coke will also form if there are cool spots in the transfer line. The cool spots allow some of the heaviest material in the reactor effluent vapor to condense. These heavy materials, some of which may be entrained asphaltenic materials, will form coke if allowed to remain for a long time in the transfer line. Thus refiners have tried to insulate the transfer line to the main column, not only to prevent heat loss to the atmosphere, but also to prevent coking in this line.

Coking in fractionators has sometimes been a problem, particularly in fractionators associated with older cracking units such as moving bed catalytic cracking (TCC) units. Some TCC units have a quench zone at the inlet of the main column associated with the TCC reactor. A heavy liquid is recycled from the column to contact hot vapor feed from the cracking reactor, and cool it enough so that a two phase mixture would enter main column. This prevented coke formation in stagnant spaces on the main column.

The problem of coke formation in transfer lines or fractionation columns gets more severe with either an increase in reactor/transfer line temperatures, or with a decrease in feed quality so that it contains more heavier materials.

It would be beneficial if a higher mix temperature could be achieved in the base of a riser reactor with lower catalyst temperatures. High temperatures are hard on the catalyst, even in a relatively dry atmosphere.

It would be beneficial if the vaporizability of the resid containing feeds could be substantially improved, without use of excessive amounts of atomizing steam or inclusion of large amounts of hydrocarbon diluents in the resid feed. Inclusion of 5 or 10 wt % steam with the resid, or added as atomizing steam, will improve vaporization, but the steam will take up half of the volume of the riser and downstream processing equipment.

I realized that the most efficient way to improve the properties of a resid feed for cat cracking was to heat it. Breaking through the traditional feed preheat limit of 300°-600° F. used in most cat crackers, and the 800° F. limit mentioned in U.S. Pat. No. 4,816,137, translates into a more pumpable, more atomizable feed.

I knew that if higher feed preheat could be achieved, the lighter feed components would function to a great extent as solvents and/or atomizing diluents.

I wanted to avoid, however, completely vaporizing a heavy feed upstream of the cracking unit. Running a coker upstream of the catalytic cracking unit, and charging only a vapor phase to the cat cracker will reduce and perhaps even eliminate the CCR from the cat cracker feed, but there is a significant yield penalty associated with a coker. The art has long recognized that the products of thermal cracking, coking or visbreaking are not particularly good feed stocks for FCC units due to resulting high concentrations of polynuclear aromatics. This is discussed in U.S. Pat. No. 4,816,137 in the review of the prior art.

Thus the art has gone in several directions in treating distress stocks such as resids. Extremely high temperatures achieved via hot catalyst or lower temperatures with a vapor feed.

The approach exemplified by U.S. Pat. No. 4,816,137 leaves the feed preheat alone, and resorts to extremely high temperature catalyst. That approach is hard on the catalyst, and uses high grade heat (1400° F. catalyst) to heat a low temperature stream (300° to 450° F. resid feed).

The other approach, coking the feed first, or use a two stage fluidized bed unit, with the first stage acting as a coker and cascading the vapor product into a second stage acting as a catalytic cracking unit, costs a lot in equipment and operating expense, and loses too much yield.

I knew that neither approach (cool liquid feed, or vapor feed from coking) was a complete solution. The approach suggested in PCT/U.S./ No. 87 0227, published as WO No. 88/01638 on Mar. 10, 1988, seemed a better solution. This approach called for fairly severe, liquid phase thermal treatment of the feed, as by visbreaking, and cascading the freshly visbroken feed into the catalytic cracking unit. In the laboratory tests reported in the patent publication, use of extremely high preheat temperature improved the octane number of the gasoline produced by cracking an Arab Light atmospheric resid.

The PCT publication suggested that cascading the liquid effluent from a visbreaking unit into an FCC would improve the cracking process. Although visbreaking is not especially complicated or expensive, it requires use of fired heaters to get the high temperatures needed for the visbreaking reactions to occur.

From the above review of cat cracking developments, it can be seen that the trend is to heavy feeds. To catalytically crack, rather than coke, heavy viscous feeds, refiners have resorted to high temperatures and high vapor velocity in the riser, and tall risers. This helped improve the cracking process and allowed FCC units to process significantly heavier feeds. Unfortunately, although the catalyst could keep pace with the heavier feed, the process could not. It became harder to heat feeds as they became heavier. To compensate, the regenerator had to run hotter. The higher catalyst temperatures, and higher operating temperatures need to crack the poor quality, high CCR feed led to thermal cracking in the cracking unit, and coking in transfer lines downstream of the unit.

Bottlenecks were developing both upstream and downstream of the cracking units. The heavier feeds were hard to vaporize in the cracking reactor. The hot products of cracking were coking the downstream processing equipment.

I examined the work that others had done, and realized that it was time for a new approach. I wanted to crack resid, but did not want to have to run the regenerator at extraordinarily high temperatures. I knew that the problems of metals contamination (Ni+V) were more severe at high regenerator temperatures, and that there had to be a better way to crack resid than shocking it with extremely hot catalyst. I did not want to tie up 20–50% of my reactor volume with atomizing steam, steam that was primarily added to promote dispersion and vaporization of "non-distillable" resid feed.

I wanted a way to take more heat out of the cracking reaction zone. If the reactor could be run hotter, and the cracked vapor leaving the reactor could be removed at a higher temperature, then more heat could be removed from the cracking unit, as compared to prior art units which operated with an upper limit of about 1000° F. for the cracked vapor from the reactor.

I realized that there was a way to overcome the limitations of existing technology. By using the hot reactor vapor to preheat the heavy feed I could efficiently preheat heavy feeds, remove more heat from the reactor and bring the FCC back into better heat balance, improve feed vaporization in the riser, and eliminate thermal reactions and coking in the transfer line to the product fractionators.

BRIEF SUMMARY OF THE INVENTION

Accordingly, the present invention provides in a catalytic cracking process wherein a heavy hydrocarbon feed comprising hydrocarbons having a boiling point above about 650° F. is catalytically cracked to cracked products comprising the steps of: catalytically cracking said feed in a catalytic cracking zone operating at catalytic cracking conditions by contacting said feed with a source of hot regenerated cracking catalyst to produce a cracking zone effluent mixture having an effluent temperature and comprising cracked products and spent cracking catalyst containing coke and strippable hydrocarbons; separating said cracking zone effluent mixture into a cracked product vapor phase having a temperature and a spent catalyst rich phase; stripping and regenerating said spent catalyst to produce regenerated catalyst which is recycled to crack heavy feed; removing said cracked product vapor via a transfer line and charging said cracked product vapor to a main fractionator; the improvement comprising preheating at least a portion of the feed to the catalytic cracking unit by direct contact heat exchange of heavy feed with said cracked product vapor phase to produce a heated feed and charging said heated feed to said cracking reaction zone.

In another embodiment, the present invention provides a fluidized catalytic cracking process for catalytic cracking of a resid containing feed comprising at least 10 wt % non-distillable hydrocarbons having a boiling point above about 1000° F. comprising: preheating at least a portion of the resid containing feed by direct contact heat exchange with a source of hot hydrocarbon vapors to produce a preheated resid having a temperature above at least 500° F.; catalytically cracking said preheated feed in a catalytic cracking zone riser reactor having a height in excess of 30 meters at catalytic cracking conditions by contacting said preheated feed with a source of hot regenerated cracking catalyst to produce a riser effluent mixture having an effluent temperature above 950° F. and comprising cracked products and spent cracking catalyst containing coke and strippable hydrocarbons; separating within a vessel said cracking zone effluent mixture into a cracked product vapor phase having a temperature above 950° F. and a spent catalyst rich phase; stripping and regenerating said spent catalyst to produce hot regenerated catalyst which is recycled to crack heavy feed; removing said cracked product vapor from said vessel via a transfer line; cooling the hot cracked vapor product by direct contact heat exchange of said hot vapor with said resid containing feed to produce a heat exchanged vapor product having a temperature below 800° F. and a preheated liquid resid containing feed having a temperature above about 600° F.; fractionating the cooled cracked vapor product to recover catalytically cracked products; and charging said preheated resid containing feed to said riser cracking reactor.

In an apparatus embodiment, the present invention provides an apparatus for the catalytic cracking of a heavy hydrocarbon feed comprising hydrocarbons having a boiling point above about 650° F. to cracked products comprising: a means for catalytic cracking of said feed comprising a catalytic cracking reactor connective with a source of hot regenerated cracking catalyst, a feed inlet, to produce a mixture of cracked products and spent catalyst a means for separating said mixture into a cracked product vapor phase and a spent catalyst rich phase; a means for stripping and regenerating said spent catalyst to produce regenerated catalyst, said stripping and regenerating means being operatively connected with said catalytic cracking reactor; a means for removing said cracked product vapor phase from said means for catalytic cracking; a means for contacting and direct contact heat exchange of at least a portion of the feed to the catalytic cracking unit with said cracked product vapor phase to produce a cooled product vapor phase and a heated feed; and a means for charging said heated feed to said means for catalytic cracking.

DETAILED DESCRIPTION

Figure 1:
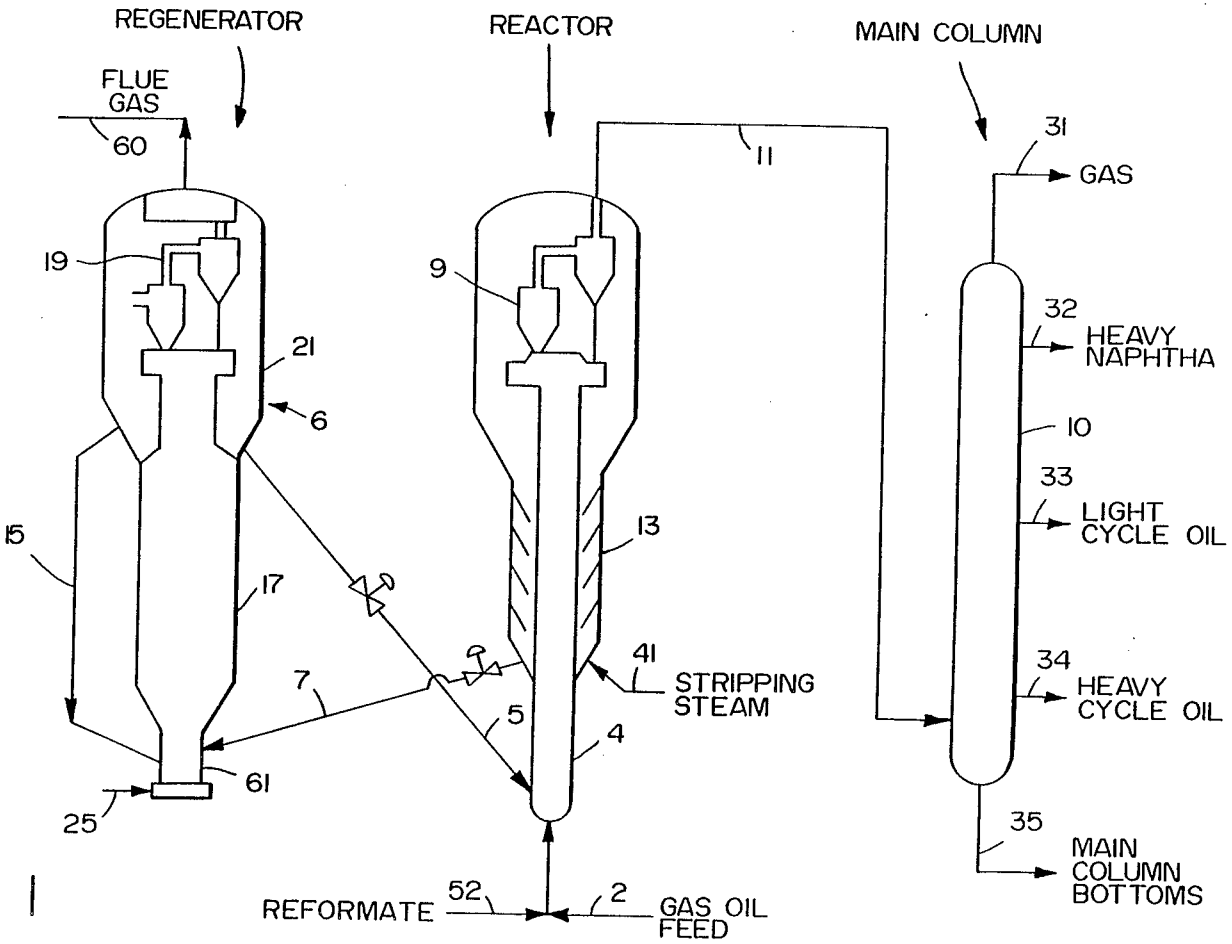
FIG. 1 (prior art) is a simplified schematic view of an FCC unit of the prior art, with all riser cracking, and a transfer line from the riser reactor to the main column.

The present invention can be better understood by reviewing it in conjunction with the conventional way of operating an all riser cracking FCC unit. FIG. 1 illustrates a fluid catalytic cracking system of the prior art. It is a simplified version of FIG. 1 of U.S. Pat. No. 4,421,636, which is incorporated herein by reference.

A heavy feed, typically a gas oil boiling range material, is charged via line 2 to the lower end of a riser cracking FCC reactor 4. Hot regenerated catalyst is added via conduit 5 to the riser. Preferably, some atomizing steam is added, by means not shown, to the base of the riser, usually with the feed. With heavier feeds, e.g., a resid, 2–10 wt. % steam may be used. A hydrocarbon-catalyst mixture rises as a generally dilute phase through riser 4. Cracked products and coked catalyst are discharged from the riser. Cracked products pass through two stages of cyclone separation shown generally as cyclone 19 in separation section 21.

The riser 4 top temperature, which usually close to the temperature in conduit 11, ranges between about 480° and 615° C. (900° and 1150° F.), and preferably between about 538° and 595° C. (1000° and 1050° F.). The riser top temperature is usually controlled by adjusting the catalyst to oil ratio in riser 4 or by varying feed preheat.

Cracked products are removed from the FCC reactor via transfer line 11 and charged to the base of the main column 30. In some refineries, this column would be called the Syncrude column, because the catalytic cracking process has created a material with a broad boiling range, something like a synthetic crude oil. The main column 30 recovers various product fractions, from a heavy material such as main column bottoms, withdrawn via line 35 to normally gaseous materials, such as the vapor stream removed overhead via line 31 from the top of the column. Intermediate fractions include a heavy cycle oil fraction in line 34, a light cycle oil in line 33, and a heavy naphtha fraction in line 32.

Cyclones 9 separate most of the catalyst from the cracked products and discharge this catalyst down via diplegs to a stripping zone 13 located in a lower portion of the FCC reactor. Stripping steam is added via line 41 to recover adsorbed and/or entrained hydrocarbons from catalyst. Stripped catalyst is removed via line 7 and charged to a high efficiency regenerator 6. A relatively short riser-mixer section 11 is used to mix spent catalyst from line 7 with hot, regenerated catalyst from line 15 and combustion air added via line 25. The riser mixer discharges into coke combustor 17. Regenerated catalyst is discharged from an upper portion of the dilute phase transport riser above the coke combustor. Hot regenerated catalyst collects as a dense phase fluidized bed, and some of it is recycled via line 15 to the riser mixer, while some is recycled via line 5 to crack the fresh feed in the riser reactor 4. Several stages of cyclone separation are used to separate flue gas, removed via line 10.

Thermal cracking degrades the cracked product removed via line 11. The average residence time in the transfer line between the FCC reactor outlet and the main column is usually in excess of 10 seconds, although some units operate with less vapor residence time.

The temperature in this line is usually the riser outlet temperature. The combination of time and temperature is enough to cause a significant amount of unselective, and unwanted, thermal cracking upstream of the main column.

There is an additional problem with the prior art design when it is used to crack feeds containing more than 10% non-distillable feeds, or when the feed contains more than trace amounts, e.g., from 0.1 to 2.0 or more % CCR. This additional problem is coke formation in the transfer line. It is somewhat related to thermal cracking in the riser, but becomes a severe problem only when heavier feedstocks are being cracked. It may be due to carryover of uncracked asphaltenic material, or continuing thermal degradation or polymerization of large aromatic molecules into coke or coke precursors.

Polymerization, or coking in the transfer line, or in the base of the main column, need not involve a large fraction of the cracked product to cause a problem with product purity or plugging of the transfer line or the main column. Phrased another way, coking in the unit could shut the unit down, but need not be noticeable in yields. Thermal cracking in the transfer line will cause a significant yield loss, but will not automatically cause coking or plugging of the transfer line. Fortunately both problems are overcome by the process of the present invention, which will be discussed in conjunction with FIG. 2.

Figure 2:
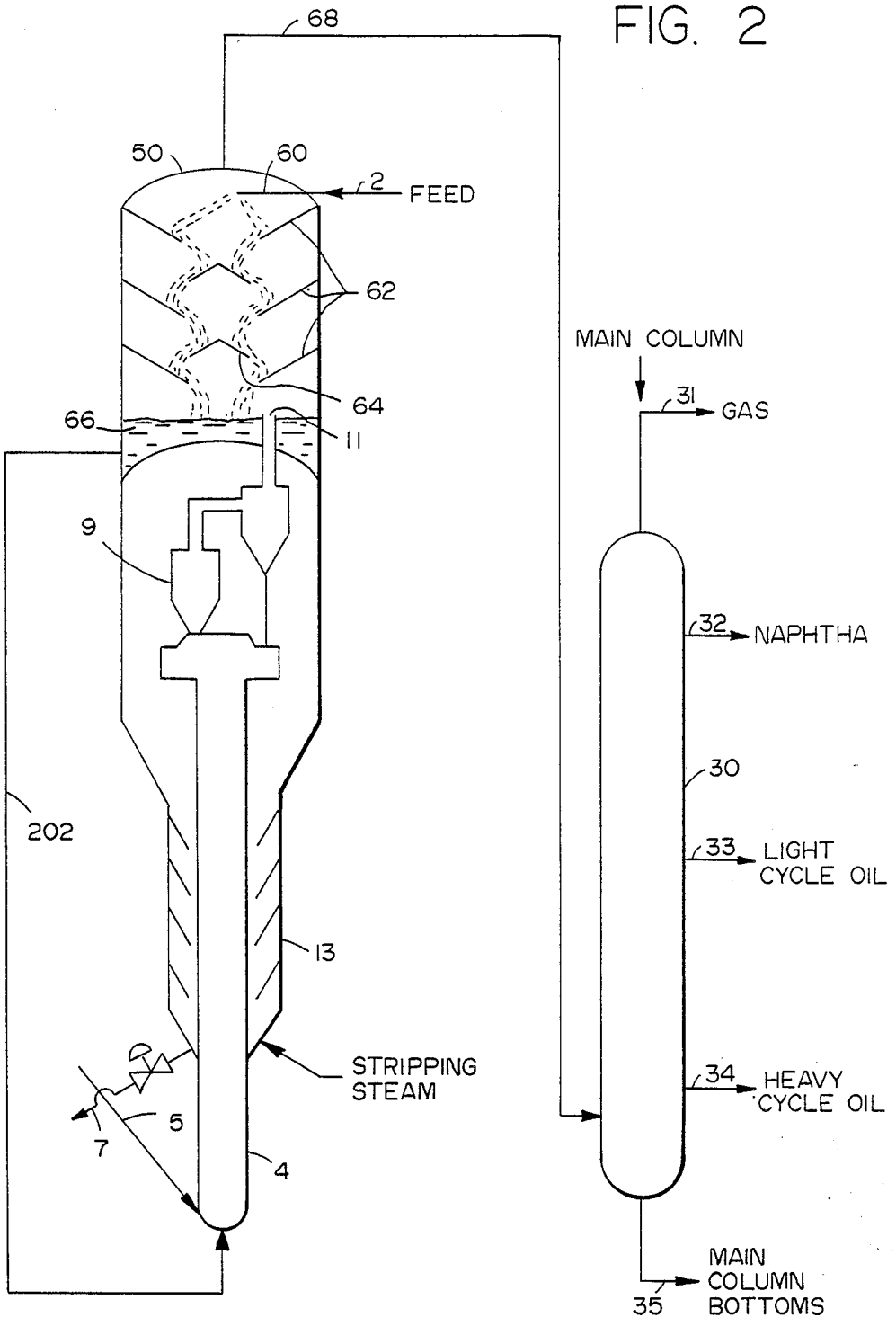
FIG. 2 is a simplified schematic view of an FCC unit of the invention, with a resid preheater above the riser outlet. This embodiment will quench thermal reactions in the reactor transfer line and preheat the resid feed.

FIG. 2 shows one embodiment of the present invention. Many of the elements in FIG. 2 are identical to those in FIG. 1, and like elements, such as main column 30, have like reference numerals in both figures.

As in the FIG. 1 embodiment, a heavy feed, preferably containing more than 10% residual or non-distillable material, is cracked in riser cracker 4. Cracked products are discharged from the riser, pass through two stages of cyclone separation 9 and are discharged via line 11 from the FCC reactor.

The cracked vapors are immediately cooled in direct contact heat exchanger 50, which is mounted on top of the FCC reactor section. Hot cracked hydrocarbons in line 11 contact at least a portion of the heavy feed. A hot, diluent liquid, such as slurry oil from the main column, may be added to thin the feed if desired. It is also possible to add relatively light diluents to the feed. Light cycle oil or even naphtha boiling range fractions may be recycled from the main column, or from other processing units, to dilute the resid feed. Dilution will reduce the viscosity of the heavy feed, and make it easier to distribute the feed in the direct contact heat exchanger. The diluent may be vaporized, in the case of naphtha or light cycle oil streams, and recovered via line 68 with cracked products in the main column. The diluent may be a heavy stream, such as a slurry oil, or clarified slurry oil, which remains a liquid in the conditions in heat exchanger 50.

Preferably a spray nozzle, or liquid distribution system, is used to aid in distributing liquid across the cross-sectional area of direct contact heat exchanger 50. The liquid passes down via multiple outer plates 62 and inner plates 64 which together define a torturous path for vapor flow. Liquid may be allowed to accumulate in a pool 66 in the base of the vessel 50, so that a high liquid flux may be achieved by recycle of this liquid.

Hot vapors from the reactor pass up into the direct contact heat exchange zone and contact descending liquid feed. This rapidly and completely quenches the cracked vapor to any desired temperature, while rapidly and efficiently preheating the feed. The FCC feed can easily be heated to a temperature within 100° to 200° F. of the riser outlet temperature then changed to reactor 4 via line 20.

Although slanted splash plates are shown in the figure, there are many other vapor liquid contacting means which can be used. A single, large, open chamber with an efficient liquid distribution system, such as a spray nozzle, can be used to contact feed with hot vapors. Packing materials, such as any conventional distillation column packing material, may be used. The conditions in the direct contact heat exchange zone are similar to those existing in the base of the main fractionator. The same methods used to achieve good vapor/liquid contact in the main column, and accommodate the presence of fines, can be used to solve the same problems in the direct contact heat exchange zone.

Large amounts of catalyst fines may collect in the heavy feed liquid. Some provision for fines removal may be provided, or recovered catalyst and fines may simply be recycled back to the cracking reactor. Filters, settling tanks and similar equipment can be used, if desired, to remove all or a portion of entrained fines.

Figure 3:
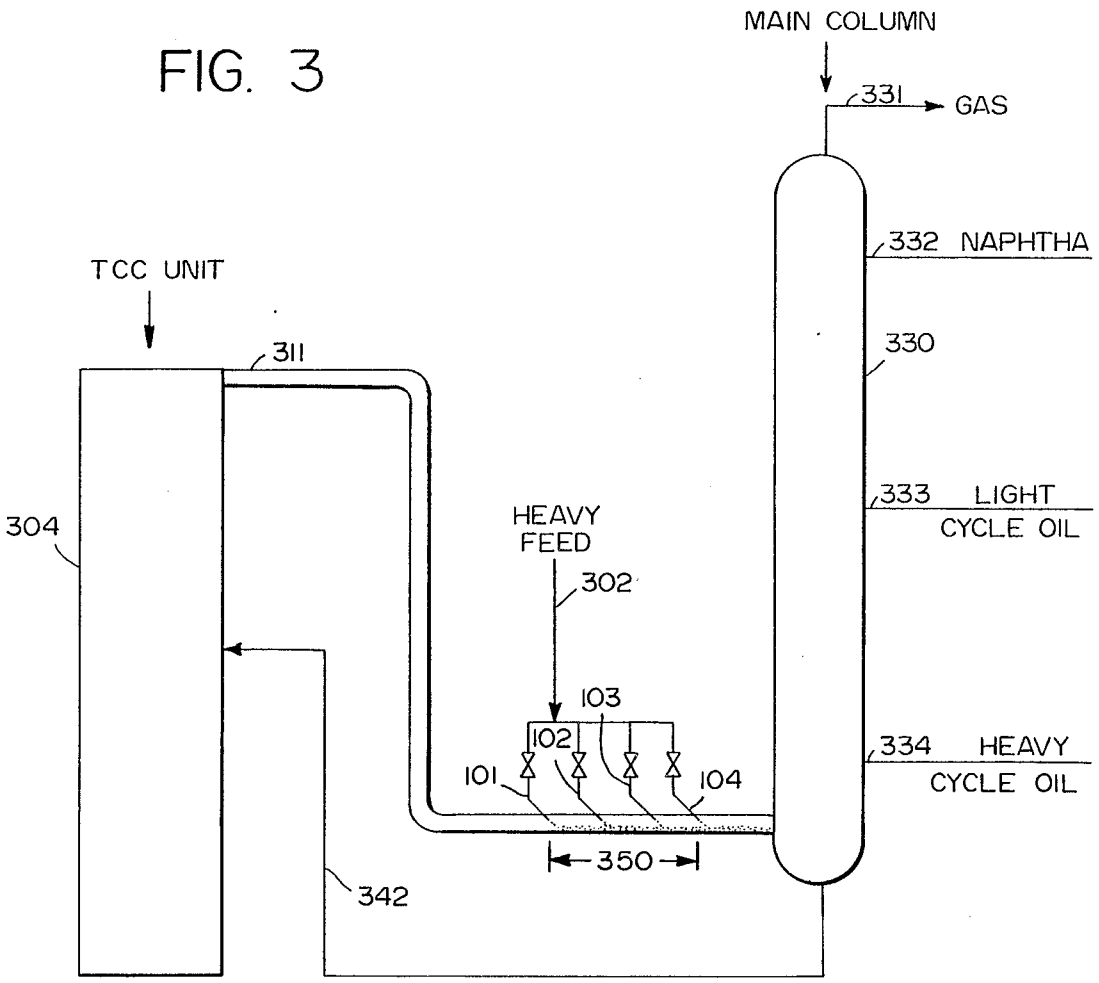
FIG. 3 is a simplified schematic view of a resid preheater at the inlet to a moving bed fractionator main column. This embodiment will preheat the resid feed, but will not reduce thermal reactions in the transfer line to the main column.

The FIG. 3 embodiment shows how the present invention may be retrofitted into an existing moving bed catalytic cracking unit to preheat a resid feed (though not, in this embodiment, to eliminate thermal reactions in the transfer line to the main column).

FIG. 3 shows one embodiment of the present invention. Most of the elements in FIG. 3 are identical to those in FIG. 2, and like elements, such as main column 330 and 30, have similar reference numerals in both figures.

A heavy feed 302, preferably containing more than 10% residual or non-distillable material, is charged via multiple sprayer means 101, 102, 103, and 104 to direct contact heat exchange zone 350, which is in the transfer line 311 just upstream of the main column 330. Fresh feed contacts the hot, cracked vapor product and cools it in the heat exchange zone 350. The heat exchange zone 350 discharges a two phase mixture of preheated feed and cooled cracked product into the base of column 330. The preheated feed is charged to the moving bed catalytic cracking unit 304 via line 342.

Moving bed catalytic cracking reactor 304 is shown as a block unit. The design of moving bed catalytic cracking reactors, and the moving bed regenerator associated with the reactor, is well known. Cracked products are discharged from the reactor via line 311. The cracked vapors are cooled in direct contact heat exchange zone 350, which is in the transfer line 311 just upstream of the main column 330. Hot hydrocarbon vapors in line 311 contact the fresh feed which is added via line 302.

Fresh feed contacts the hot, cracked vapor product, cools it in the heat exchange zone 350, and discharges a two phase mixture of preheated feed and cooled cracked product into the base of column 330. The liquid phase contains preferably 90% or more of the heavy feed added via line 302, and less than 10 wt % of the cracked products in line 311. The vapor phase discharged into column preferably comprises at least 90 wt % of the cracked products discharged from the cracking reactor 304.

The preheated feed liquid is withdrawn from the base of the main column 330 and charged to the moving bed catalytic cracking reactor 304 via line 342. The cracked product vapors proceed up column 330 for conventional fractionation.

There will be some loss, or vaporization, of distillable hydrocarbons from the heavy feed to the distillation column. This is inherent in direct contact heat exchange, however, there is not too much penalty associated with this feed vaporization, because readily vaporizable materials can be mixed with catalytically cracked products. Vaporization of feed can be minimized by using a heavier feed, or by splitting the feed just upstream of the cracking unit, and charging the readily vaporizable material directly to the cracking unit, and sending only the heaviest fraction to the direct contact heat exchange zone.

There will also be some recycle of cracked products back to the cracking reactor, because the heaviest ends will condense in the heavy feed. This recycle can be beneficial, especially when processing feeds containing large amounts of residual material. The recycle liquid is an efficient cutter stock or solvent, which improves the pumpability of the heavy feed. The heavy feed, with some condensed heavy cycle oil in it, is much less viscous, which improves heat exchange. The recycle of a heavy fraction to the cracking reactor also gives the cracking reactor another chance to convert a heavy, low value material to a more valuable lighter product.

It may be beneficial in some units to limit the amount of recycle of, e.g., heavy cycle oil from column 330 back to the cracking reactor. This can be achieved by reducing the efficiency of the direct contact heat exchange step, or by reducing the amount of heavy feed added to the direct contact heat exchange step, so that the vapor temperature stays very high in the direct contact heat exchange zone, and in the base of the main column, so that very little heavy cracked product is condensed in, and recycled with, the heavy feed.

To prevent buildup of a heavy recycle material from the base of the column it may be beneficial in some units to provide a relatively small vapor liquid separator just upstream of the column. Use of an upstream contactor/separator, and running it with only limited amounts of resid feed, will permit some of the highly condensed, aromatic products of catalytic cracking to remain in the vapor phase and enter the main column and be removed, rather than be recycled with the resid feed.

If buildup of a refractory recycle material is a problem in a unit, an additional stage of fractionation, preferably vacuum fractionation, may be provided to remove as much distillable material as desired from the preheated resid prior to catalytic cracking. There will not be much operating, or capital expense, associated with such a recovery column because the preheated resid will be extremely hot already, and very low efficiency fractionation can be tolerated with little economic penalty.

Preferably a spray nozzle, or liquid distribution system, is used to aid in distributing heavy feed liquid across the cross-sectional area of direct contact heat exchange zone 350 in line 311.

Preferably the amount and manner of heavy feed liquid addition is controlled so that less than 10 wt % of the heavy feed liquid vaporizes, and less than 10 wt % of the reactor effluent vapors condense in the direct contact heat exchange zone.

The present in invention can easily be retrofit into existing moving bed cracking units because all of these units now operate with quenching of hot reactor effluent vapors at the inlet to the main column. This is because many of these older units have bubble cap trays, and there is concern about coking in the base of the column, in areas where there are no active liquid flows due to plugging of a tray.

Operation of the moving bed cracking reactor, regenerator or kiln, and related equipment can be conventional. The only change in unit operation that is essential is diversion of all, or ideally the heaviest fraction such as the resid portion of the feed, to the quench zone or direct contact heat exchange zone associated with the inlet of the TCC main column.

Direct contact heat exchange can occur upstream of the main column, as shown in FIG. 3, or within the main column. There are benefits and detriments associated with both approaches.

Upstream contacting prevents coke formation in the base of the TCC main column. The contacting of heavy feed or resid preferably occurs just upstream of the column ensures that a two phase mixture of preheated heavy feed and cracked products enters the column. Use of the existing quench setup, substituting heavy feed for a stream recycled from the main column, will minimize the cost of implementing the present invention. The heavy feed will usually not be as easy to distribute or spray in the quench/heat exchange zone, because the heavy feed will usually be more viscous, so some modifications may be needed to handle the heavy feed which is now being used as quench liquid, or to thin the heavy feed with some recycled hot liquid from the column bottoms.

Quenching within the main column, as opposed to upstream of it as shown in FIG. 3, requires some modification of the main column. This can be done by removing some of the bubble cap trays from the bottom of the tower, and adding modern mesh packing material, to allow efficient contact of heavy feed with hot cracked product vapor entirely within the main column, or in a vapor liquid contact vessel or heavy feed drum just upstream of the main column. This requires a considerably expense for unit modifications, but may be justified by more efficient direct contact heat exchange of heavy feed with hot cracked vapor.

A hybrid approach is to quench upstream of the column, but add the heavy feed to the base of the main column, and let the added heavy feed liquid mix with the hot liquid already in the base of the column. There will be efficient liquid/liquid heat exchange, but very little additional cooling of cracked vapor in the column. This heated, and somewhat diluted heavy feed liquid can then be recycled to the conventional quench means heretofore used upstream of the TCC main column. The feed to the cracking unit can be a drag stream from the main column bottoms.

Now that the invention has been briefly reviewed in conjunction with the review of FIGS. 2 and 3, a more detailed discussion of feed, catalyst, and equipment will be presented.

HEAVY FEED

Any conventional cracking feed can be used. The process of the present invention is especially useful for processing difficult charge stocks, those with high levels of CCR material, exceeding 2, 3, 5 and even 10 wt % CCR.

The feeds may range from the typical, such as petroleum distillates or residual stocks, either virgin or partially refined, to the atypical, such as coal oils and shale oils. The feed frequently will contain recycled hydrocarbons, such as light and heavy cycle oils which have already been subjected to cracking.

Preferred feeds are gas oils, vacuum gas oils, atmospheric resids, and vacuum resids. The present invention is most useful with feeds having an initial boiling point above about 650° F.

The most uplift in value of the feed will occur when at least 10 wt %, or 50 wt % or even more of the feed has a boiling point above about 1000° F., or is considered non-distillable.

CRACKING CATALYST

Any commercially available FCC or TCC catalyst may be used. The catalyst can be 100% amorphous, but preferably includes some zeolite in a porous refractory matrix such as silica-alumina, clay, or the like. The zeolite is usually 5–40 wt. % of the catalyst, with the rest being matrix. Conventional zeolites include X and Y zeolites, with ultra stable, or relatively high silica Y zeolites being preferred. Dealuminized Y (DEAL Y) and ultrahydrophobic Y (UHP Y) zeolites may be used. The zeolites may be stabilized with Rare Earths, e.g., 0.1 to 10 Wt % RE.

Relatively high silica zeolite containing catalysts are preferred for use in the present invention. They withstand the high temperatures usually associated with complete combustion of CO to CO2 within the regenerator.

The catalyst inventory may also contain one or more additives, either present as separate additive particles, or mixed in with each particle of the cracking catalyst. Additives can be added to enhance octane (shape selective zeolites, i.e., those having a Constraint Index of 1–12, and typified by ZSM-5, and other materials having a similar crystal structure), adsorb SOX (alumina), remove Ni and V (Mg and Ca oxides).

Good additives for removal of SOx are available from several catalyst suppliers, such as Davison's "R" or Katalistiks International, Inc.'s "DeSox."

CO combustion additives are available from most FCC and TCC catalyst vendors.

The catalyst composition, per se, forms no part of the present invention.

THERMAL REACTIONS

It is preferred to preheat the heavy feed enough so that at least some liquid phase thermal cracking reactions are achieved. Because the liquid feed will be preheated to temperatures where thermal reactions may occur, a significant amount of visbreaking can be achieved merely by providing a few seconds or minutes of residence time intermediate the cracking reactor and the feed preheater.

Preferably at least 50 seconds of equivalent reaction time (ERT) at 800° F. are provided. Preheating the feed to 800° F., and providing enough piping volume to give a liquid residence time of one minute between preheating and cracking will provide an ERT of at least 60 seconds. ERT is a well known concept in visbreaking and coking, and many published correlations are available to correlate time and temperature and estimate an ERT severity. Operation with 100–1000 ERT seconds, and most preferably at 200–600 ERT seconds will give a significant amount of thermal cracking of the resid containing feed.

If desired, some additional heating of the preheated resid may be achieved via a fired heater, or by indirect heat exchange with some other hot refinery stream, e.g., a hot catalyst stream or flue gas stream. Indirect heat exchange of preheated resid with the contents of the riser reactor may be used to quench the riser, while further preheating the feed. It is also possible to reverse the sequence, and indirectly heat exchange relatively cool heavy feed with some hot process stream, such as the contents of the riser reactor, and then further heat the heavy feed by direct contact heat exchange.

DIRECT CONTACT HEAT EXCHANGE CONDITIONS

Although direct contact heat exchange of heavy feed to a cat cracker has never been done before, the design of such a unit is simple. All of the technology needed has already been developed for use in a coker, where direct contact heat exchange of resid with hot vapors from the coke is routinely used to preheat the coker feed. The same hardware can be used, i.e., the only modifications needed being those to accommodate the presence of large amounts of catalyst fines. This technology, slanting trays, absence of dead zones on trays, etc., has been well developed for the FCC main column.

In cokers the feed is usually preheated in the base of the main fractionator associated with the coker. Although direct contact heat exchange can be practiced, as shown in FIG. 3, just upstream of the base of the FCC Syntower or main column, it is preferable to practice direct contact heat exchange near the reactor outlet. Direct contact heat exchange near the reactor outlet minimizes undesirable thermal reactions in the transfer line to the main column.

The vapor inlet temperature will usually be the riser outlet temperature. A small amount of indirect heat exchange may be practiced either immediately before or after the direct contact heat exchange step to remove additional heat from the reactor effluent vapor, or to provide more control of the temperature of the process. It may be necessary in some units to closely control the cracked vapor temperature from the quench zone, to minimize thermal cracking or coke deposition in the transfer line. In other units it may be more important to control the temperature of the resid or other heavy liquid feed, and for this application some heat can be removed from the reactor effluent vapor upstream of the direct contact heat exchange means.

The temperature of the vapor exiting the direct contact heat exchange zone will be significantly less than that of the reactor effluent vapor, usually by 50°-100° F. or more. To minimize thermal reactions in the transfer line to the main column, the cooled, cracked vapor temperature can be reduced below 800° F. Operation with temperatures much below 750° F. will not usually be preferred, because too much of the cracked product will be condensed, and some additional heat input to the main column may then be needed. Such a condensing operation may be preferred when the feeds are so heavy that a large amount of diluent in the feed is beneficial, and/or a large amount of recycle (high combined feed ratio) is needed to achieve adequate conversion. For these modes of operation, condensation of 5 to 25 wt % of the cracked product into the heavy feed will give good results, and also shift some fractionation from the main column to the direct contact heat exchange zone.

REACTOR CONDITIONS

Conventional catalytic cracking conditions may be used. Typical riser cracking FCC reaction conditions include catalyst/oil ratios of 0.5:1 to 15:1 and preferably 3:1 to 8:1, and a catalyst contact time of 0.1-50 seconds, and preferably 0.5 to 5 seconds, and most preferably about 0.75 to 4 seconds, and riser top temperatures of 900° to about 1050° F.

The process of the present invention tolerates and encourages use of unconventional FCC riser reactor conditions. Riser top temperatures of 1100° F., 1150° F., 1200° F. or even higher can be tolerated in the process of the present invention, and are preferred when the feed is heavy, and contains 10% or more of resid. Unusually short riser residence times are possible at such high temperatures, so riser hydrocarbon residence times of 0.1 to 5 seconds may be used., e.g., 0.2 to 2 seconds.

It is preferred, but not essential, to use an atomizing feed mixing nozzle in the base of the riser reactor, such as ones available from Bete Fog. More details of use of such a nozzle in FCC processing is disclosed in USSN No. 229,670, which is incorporated herein by reference.

It is preferred, but not essential, to have a riser catalyst acceleration zone in the base of the riser.

It is preferred, but not essential, to have the riser reactor discharge into a closed cyclone system for rapid and efficient separation of cracked products from spent catalyst. A preferred closed cyclone system is disclosed in U.S. Pat. No. 4,502,947 to Haddad et al.

It is preferred but not essential, to rapidly strip the catalyst, immediately after it exits the riser, and upstream of the conventional catalyst stripper. Stripper cyclones disclosed in U.S. Pat. No. 4,173,527, Schatz and Heffley, which is incorporated herein by reference, may be used.

It is preferred, but not essential, to use a hot catalyst stripper. Hot strippers heat spent catalyst by adding some hot, regenerated catalyst to spent catalyst. Suitable hot stripper designs are shown in U.S. Pat. No. 3,821,103, Owen et al, which is incorporated herein by reference. If hot stripping is used, a catalyst cooler may be used to cool the heated catalyst before it is sent to the catalyst regenerator. A preferred hot stripper and catalyst cooler is shown in U.S. Pat. No. 4,820,404, Owen, which is incorporated herein by reference.

The reactor and stripper conditions, per se, can be conventional. In many refineries, the existing reactor and stripper can be left untouched, and the unit modified by adding a direct contact heat exchange means intermediate the vapor outlet from the reactor section and the main column.

CATALYST REGENERATION

The process and apparatus of the present invention can use conventional FCC or TCC regenerators.

Preferably a high efficiency regenerator, such as is shown in the Figures, is used. The essential elements of a high efficiency regenerator include a coke combustor, a dilute phase transport riser and a second dense bed. Preferably, a riser mixer is used. These regenerators are widely known and used.

The process and apparatus can also use conventional, single dense bed regenerators, or other designs, such as multi-stage regenerators, etc. The regenerator, per se, forms no part of the present invention. In most units, the existing regenerator will be used to practice the present invention.

CO COMBUSTION PROMOTER

Use of a CO combustion promoter in the regenerator or combustion zone is not essential for the practice of the present invention, however, it is preferred. These materials are well-known.

U.S. Pat. No. 4,072,600 and U.S. Pat. No. 4,235,754, and U.S. Pat. No. 4,473,658, which are incorporated by reference, disclose operation of an FCC and a TCC regenerator with minute quantities of a CO combustion promoter. From 0.01 to 100 ppm Pt metal or enough other metal to give the same CO oxidation, may be used with good results. Very good results are obtained with as little as 0.1 to 10 wt. ppm platinum present on the catalyst in the unit. Pt can be replaced by other metals, but usually more metal is then required. An amount of promoter which would give a CO oxidation activity equal to 0.3 to 3 wt. ppm of platinum is preferred.

Conventionally, refiners add CO combustion promoter to promote total or partial combustion of CO to CO2 within the regenerator. More CO combustion promoter can be added without undue bad effect—the primary one being the waste of adding more CO combustion promoter than is needed to burn all the CO.

The present invention can operate with relatively small levels of CO combustion promoter while still achieving relatively complete CO combustion because the heavy feeds contemplated for use herein will usually deposit large amounts of coke on the catalyst, and give extremely high regenerator temperatures.

COMPARISON OF ESTIMATED YIELDS

The benefits of practicing the present invention can show up in several ways, i.e., in improved yields in the cracking reactor due to higher feed preheat, better yields due to better heat balance, or better yields due to reduced coking in the transfer line. The following ignores the benefits on the reaction side, and looks only at the improvement in yields obtained by eliminating thermal reactions in the transfer line downstream of the direct contact heat exchange zone.

The yields obtainable in a conventional, prior art FCC unit are compared to an estimate of the yields obtainable in the same unit by adding a direct contact heat exchange means or a quench drum which functions as a resid preheater on top of the vessel containing the riser reactor outlet, cyclones, etc. The yields reflect a reduction of thermal reactions in the transfer line.

The prior art unit estimate is based on yields obtainable in a conventional unit operating with a riser reactor, a high efficiency regenerator, and a conventional catalyst stripper, a conventional transfer line to the main column, and a conventional main column or fractionator.

The reactor conditions included:

Riser Top Temperature=1000° F.

Riser Top Pressure=32 psig

Cat:Oil Ratio=6.5:1

The feed had a specific gravity of 0.9075. Under these conditions, the unit achieved a 76.11 vol % conversion of feed.

The reactor discharged into a plenum having a volume of 2,154 cubic feet. The transfer line from the plenum to the main column, a volume of 3,291 cubic feet, was about 225 feet of 54" OD line.

The following yield estimate is presented in two parts. The first or base case is with no changes. The unit operates with a plenum chamber and conventional fractionator. The second case uses a direct contact heat exchange zone mounted just downstream of the reactor vapor outlet. The second case continues to use the plenum.

DIRECT CONTACT HEAT EXCHANGE

| CASE | BASE | INVENTION |
|---|---|---|
| Conversion, Vol. % - = | 76.11 | −0.10 |
| Gasoline Yield, Vol % | 58.12 | 0.16 |
| Gasoline Octane, RONCL | | −0.09 |
| C2 and lighter wt % | 4.22 | −0.10 |
| C3 + C4 olefins, vol % | 15.06 | −0.15 |
| iC4 vol % | 5.32 | 0.01 |
| Light Fuel Oil | 18.27 | 0.16 |
| Heavy Fuel Oil | 5.62 | −0.06 |
| G + D vol % | 76.39 | 0.32 |
| Coke (weight %) | 5.12 | 0 |
| Diene, ppm, approx. | 5000 | 1000 |
| Acetylenes, ppm | 500 | low |

The practice of the present invention decreases thermal cracking. The ERT, or equivalent reaction time at 800° F. has been greatly reduced. The residence time has been reduced from about 3.0 seconds to one second or less using the inverted fractionator of the invention. This reduction in thermal cracking increases yields of valuable liquid product, and improves product quality. There is a slight decrease in gasoline octane number because thermal cracking produces olefinic gasoline which has a good octane number. Thermal cracking also reduces yields of gasoline The process of the invention can produce even larger increases in G+D yields, or gasoline plus distillate yields, by about 0.80 vol % in new units. This can be done by eliminating the plenum chamber, and putting the direct contact heat exchange zone close to the riser outlet.

In the commercially sized unit which was the basis for this study, processing 96.5 thousand barrels per day of feed, the practice of the present invention results in an increase of 309 barrels of gasoline and distillate product, merely by using the heavy feed as a quench medium in a quench zone located near the reactor outlet.

In a new unit, with the plenum eliminated, 772 more barrels of gasoline and distillate product could be obtained as compared to the conventional design with plenum and conventional fractionator.

The process and apparatus of the present invention will allow higher riser top temperatures to be used, and these higher reactor top temperatures will lead to several other benefits which will occur in practice, but are not reflected in the above yield estimates.

Higher riser top temperatures allow more heat to be removed from the FCC unit with the cracked products. Less heat must be removed in the regenerator. This helps to keep the unit in heat balance. This heat is eventually recovered in downstream fractionators or heat exchangers.

Catalyst stripping will be slightly better at higher temperatures, so higher riser top temperatures will improve somewhat the stripping operation.

Vaporization of all feeds, and especially of resids, is favored by higher reactor temperatures. In conventional FCC units much of the base of the riser is devoted to vaporizing the feed. Direct contact heat exchange will preheat the feed to an extremely high temperature just upstream of the catalytic cracking zone. This high feed preheat will reduce the viscosity of the feed and make it easier to obtain a fine dispersion of feed in the base of, e.g., a riser reactor. This allows more of the riser to be used for vapor phase cracking, rather than vaporization of liquid.

Much of the high grade energy in the hot cracked vapor products will be recaptured in the form of hot feed. More importantly, this heat in the cracked product vapor will be used to heat the incoming heavy feed just the right amount. No longer will high grade heat (in the form of 1200°-1400° F. hot, regenerated catalyst) be wasted in bringing relatively cold feed (200°-400° F.) to the desired temperature in the base of the riser. Cracked product leaving the riser, at 900°-1100° F., can be used to preheat the heavy feed to within 50°-200° F. of the riser outlet. The approach (delta T between riser outlet and preheated feed temperature leaving the direct contact heat exchange zone) can be kept roughly constant, so that if the riser top temperature is lowered 20° F. the temperature of the preheated feed will also drop around 20° F., so control of the unit will be simplified. The hot, regenerated catalyst will be needed only to take the hot feed the last few hundred degrees to the desired temperature.

Less atomization steam will be needed because of the greatly reduced viscosity of the resid. The use of 1300° F. catalyst to heat low grade dispersion steam to 1000° F. or so and produce large volumes of sour water will be greatly reduced.

Direct contact heat exchange is beneficial in other ways as well. The higher feed preheat temperatures achieved will lead to better vaporization, better catalyst:oil contact, and better conversion. Reduced catalyst circulation will be possible, because the unit can stay in heat balance with less catalyst circulation. Reduced catalyst circulation will reduce cat:oil coke, which is really a measure of hydrocarbons which are unavoidably swept into the regenerator with the spent catalyst despite steam stripping. Reducing catalyst circulation by 50% will reduce cat:oil coke by 50%, and perhaps reduce total coke make by 5 to 20%.

Because of the increased coke make frequently associated with heavy feeds, it may be desirable to put in steam coils, or shift to partial CO combustion to get excess heat out of the regenerator. Use of hot catalyst to generate high grade steam, for power generation or other uses in the refinery is a more efficient use of the thermal energy in coke on catalyst than using this heat to make sour water.

I CLAIM

1. In a catalytic cracking process wherein a heavy hydrocarbon feed comprising hydrocarbons having a boiling point above about 650° F. is catalytically cracked to cracked products comprising the steps of:

a. catalytically cracking said feed in a catalytic cracking zone operating at catalytic cracking conditions by contacting said feed with a source of hot regenerated cracking catalyst to produce a cracking zone effluent mixture having an effluent temperature and comprising cracked products and spent cracking catalyst containing coke and strippable hydrocarbons;

b. separating said cracking zone effluent mixture into a cracked product vapor phase having a temperature and a spent catalyst rich phase;

c. stripping and regenerating said spent catalyst to produce regenerated catalyst which is recycled to crack heavy feed;

d. removing said cracked product vapor via a transfer line and charging said cracked product vapor to a main fractionator;

the improvement comprising preheating at least a portion of the feed to the catalytic cracking unit by direct contact heat exchange of heavy feed with said cracked product vapor phase to produce a heated feed and charging said heated feed to said cracking reaction zone.

2. The process of claim 1 wherein the heavy feed heated by direct contact heat exchange comprises at least 10 wt % hydrocarbon having a boiling point above about 1000° F.

3. The process of claim 1 wherein the heavy feed heated by direct contact heat exchange comprises at least 50 wt % hydrocarbons boiling above about 1000° F.

4. The process of claim 1 wherein the heavy feed is heated to a temperature above 500° F. by direct contact heat exchange.

5. The process of claim 1 wherein the heavy feed is heated to a temperature above about 800° F. by direct contact heat exchange and the ratio of catalyst to oil in the catalytic cracking reaction zone is reduced by at least 50%, as compared to operation of the catalytic cracking reaction zone operating with a feed preheated to less than 400° F.

6. The process of claim 1 wherein the direct contact heat exchange of heavy feed with cracked product vapor occurs at the inlet to, or in the base of the main fractionator associated with the catalytic cracking reactor.

7. The process of claim 1 wherein the direct contact heat exchange of heavy feed with cracked product vapor occurs in a vapor liquid contact means located at the outlet of the catalytic cracking reactor.

8. The process of claim 1 wherein the direct contact heat exchange of heavy feed with cracked product vapor occurs downstream of the reactor outlet and upstream of the main fractionator.

9. The process of claim 1 wherein the direct contact heat exchange of heavy feed with cracked product vapor occurs by spraying heavy feed liquid down through an upflowing stream of hot, cracked vapor from the cracking reactor.

10. A fluidized catalytic cracking process for catalytic cracking of a resid containing feed comprising at least 10 wt % non-distillable hydrocarbons having a boiling point above about 1000° F. comprising:

a. preheating at least a portion of the resid containing feed by direct contact heat exchange with a source of hot hydrocarbon vapors to produce a preheated resid having a temperature above at least 500° F.;

b. catalytically cracking said preheated feed in a catalytic cracking zone riser reactor having a height in excess of 30 meters at catalytic cracking conditions by contacting said preheated feed with a source of hot regenerated cracking catalyst to produce a riser effluent mixture having an effluent temperature above 950° F. and comprising cracked products and spent cracking catalyst containing coke and strippable hydrocarbons;

b. separating within a vessel said cracking zone effluent mixture into a cracked product vapor phase having a temperature above 950° F. and a spent catalyst rich phase;

c. stripping and regenerating said spent catalyst to produce hot regenerated catalyst which is recycled to crack heavy feed;

d. removing said cracked product vapor from said vessel via a transfer line;

e. cooling the hot cracked vapor product by direct contact heat exchange of said hot vapor with said resid containing feed to produce a heat exchanged vapor product having a temperature below 800° F. and a preheated liquid resid containing feed having a temperature above about 600° F.;

f. fractionating the heat exchanged vapor product to recover catalytically cracked products; and g. charging said preheated resid containing feed to said riser cracking reactor.

11. The process of claim 10 wherein the heavy feed heated by direct contact heat exchange is selected from the group of resid and vacuum resid.

12. The process of claim 11 wherein the heavy feed heated by direct contact heat exchange comprises at least 50 wt % hydrocarbons boiling above about 1000° F.

13. The process of claim 11 wherein the heavy feed is heated to a temperature above 750° F. by direct contact heat exchange.

14. The process of claim 11 wherein the heavy feed is heated above about 800° F. by direct contact heat exchange and the ratio of catalyst to oil in the catalytic cracking reaction zone is reduced by at least 50%, as compared to operation of the catalytic cracking reaction zone operating with a feed preheated to less than 400° F.

15. The process of claim 11 wherein the cracked product vapor has a residence time in the transfer line in excess of 1 second and the direct contact heat exchange of heavy feed with cracked product vapor occurs at a location such that the residence time of the vapor prior to direct contact heat exchange is less than 1 second.

16. The process of claim 11 wherein the direct contact heat exchange of heavy feed with cracked product vapor occurs in a vapor liquid contact means located at the outlet of the catalytic cracking reactor.

17. The process of claim 11 wherein the direct contact heat exchange of heavy feed with cracked product vapor occurs by spraying heavy feed liquid down through an upflowing stream of hot, cracked vapor from the cracking reactor.

18. A process for preheating a hydrocarbon feed comprising hydrocarbons boiling above about 650° F. to a catalytic cracking unit comprising:

a. catalytically cracking the preheated feed, from a hereafter specified source, in a catalytic cracking unit operating at catalytic cracking conditions by contacting said feed with a source of regenerated catalytic cracking catalyst having a temperature above 1250° F. to produce cracked products having a temperature above 1000° F. and spent catalyst;

b. separating cracked product from spent cracking catalyst in a separation zone to produce a vapor phase of cracked product having a temperature above 1000° F. and a spent catalyst phase;

c. regenerating said spent catalyst by contact with oxygen or oxygen-containing gas in a catalyst regeneration zone operating at catalyst regeneration conditions including a temperature above 1250° F. to produce regenerated catalyst having a temperature above 1250° F.;

d. preheating at least a portion of the feed by direct contact heat exchange of feed with the cracked product vapor phase having a temperature above 1000° F. to produce a preheated feed; and e. charging the preheated feed to the catalytic cracking unit specified above.

* * * * *